US009590324B2

(12) United States Patent
Koda et al.

(10) Patent No.: US 9,590,324 B2
(45) Date of Patent: Mar. 7, 2017

(54) TERMINAL-EQUIPPED ELECTRICAL WIRE

(71) Applicant: YAZAKI CORPORATION, Minato-ku, Tokyo (JP)

(72) Inventors: Yoshitaka Koda, Shizuoka (JP); Shunya Tsuge, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/940,281

(22) Filed: Nov. 13, 2015

(65) Prior Publication Data

US 2016/0072205 A1 Mar. 10, 2016

Related U.S. Application Data

(63) Continuation of application No. PCT/JP2014/064098, filed on May 28, 2014.

(30) Foreign Application Priority Data

May 29, 2013 (JP) ..... 2013-112613

(51) Int. Cl.
*H01R 9/05* (2006.01)
*H01R 11/12* (2006.01)
*H01B 7/00* (2006.01)

(52) U.S. Cl.
CPC ..... *H01R 11/12* (2013.01); *H01B 7/00* (2013.01)

(58) Field of Classification Search
CPC ..... H01R 11/12; H01B 7/00; H02G 15/02; H02G 1/14
USPC ..... 174/74 R
See application file for complete search history.

(56) References Cited

U.S. PATENT DOCUMENTS 1,751,405 A * 3/1930 Herman ..... H01R 11/12 29/461
4,317,277 A * 3/1982 Bennett ..... B23K 11/163 174/94 R
5,191,710 A 3/1993 Fujimaki et al.
2002/0034898 A1* 3/2002 Kuwayama ..... H01R 4/185 439/877
2009/0078447 A1 3/2009 Brantsch et al.
2009/0269970 A1* 10/2009 Kumakura ..... H01R 43/0486 439/421

(Continued)

FOREIGN PATENT DOCUMENTS

JP H04-249875 A 9/1992
JP 2009-076462 A 4/2009
JP 2012-209017 A 10/2012

*Primary Examiner* — Sherman Ng
(74) *Attorney, Agent, or Firm* — Mots Law, PLLC

(57) ABSTRACT

A terminal-equipped electrical wire includes: a covered electrical wire in which an outer periphery of a core wire including a plurality of element wires is covered by a cover portion; and a terminal portion that is provided to an end portion of the covered electrical wire and that is configured as a terminal by exposing the core wire from the cover portion and providing a connection hole to the core wire. At the terminal portion, the element wires of the core wire are divided into two divided sections, the tip of each of the divided sections is folded back toward a base portion in order to form the connection hole, a conductive member is arranged between the divided sections, and a resistance welder is used to configure the terminal.

4 Claims, 3 Drawing Sheets

(56) References Cited

U.S. PATENT DOCUMENTS

| | | | | |
|---|---|---|---|---|
| 2012/0125684 | A1* | 5/2012 | Matsushita | H01R 4/62<br>174/74 R |
| 2013/0112738 | A1* | 5/2013 | Ito | H01R 4/023<br>228/131 |
| 2015/0079825 | A1* | 3/2015 | Miyamoto | H01R 4/206<br>439/152 |
| 2015/0236494 | A1* | 8/2015 | Mori | H02G 15/02<br>174/74 R |

* cited by examiner

TERMINAL-EQUIPPED ELECTRICAL WIRE

CROSS REFERENCE TO RELATED APPLICATIONS

This application is a continuation of International Application No. PCT/JP2014/064098, filed May 28, 2014, and based upon and claims the benefit of priority from Japanese Patent Application No. 2013-112613, filed May 29, 2013, the entire contents of all of which are incorporated herein by reference.

TECHNICAL FIELD

The present invention relates to a terminal-equipped electrical wire.

BACKGROUND ART

As a conventional example, there is known a terminal-equipped electrical wire including a covered electrical wire in which the outer periphery of a core wire composed of a plurality of element wires is covered by a cover portion, and a terminal portion that is provided at the end portion of the covered electrical wire and that is configured as a terminal by exposing the core wire from the cover portion and providing a connection hole in the core wire (see JP H04-249875 A).

In the terminal-equipped electrical wire of the conventional example, the element wires of the core wire are bundled at the terminal portion and the tips of the bundled element wires are folded back toward a base portion to form the connection hole and also configured as a terminal by an electric resistance welder having electrodes.

SUMMARY OF INVENTION

In the terminal-equipped electrical wire of the conventional example, the tips of the element wires bundled at the terminal portion are folded back toward the base portion. For this reason, when heating with use of the electric resistance welder, heat is not easily generated in the core wire, and that has often caused a problem that the element wires positioned at the center side of the core wire are not molten sufficiently. Such an insufficient melting of the core wire at the terminal portion would cause resistances among the element wires to be elevated, thereby increasing the resistance of the terminal portion.

Therefore, an object of the present invention is to provide a terminal-equipped electrical wire capable of improving heat generating property of a terminal portion by an electric resistance welder, thereby allowing element wires to be molten sufficiently.

A terminal-equipped electrical wire according to an aspect of the present invention includes: a covered electrical wire in which an outer periphery of a core wire including a plurality of element wires is covered by a cover portion; and a terminal portion provided at an end portion of the covered electrical wire and also configured as a terminal by exposing the core wire from the cover portion and providing a connection hole in the core wire. At the terminal portion, the element wires of the core wire are divided into two or more divided sections, and respective tips of the divided sections are folded back toward a base portion, thereby forming a connection hole. Then, a conductive member is arranged between the divided sections, and the terminal portion is configured as the terminal by using an electric resistance welder.

The terminal portion is configured as the terminal by the electric resistance welder under condition that the conductive member is arranged between the divided sections. Thus, owing to the heating by the electric resistance welder through the conductive member, it is possible to melt the element wires at the divided sections sufficiently, thereby allowing the resistance of the terminal portion to be reduced.

Thus, by interposing the conductive member between the divided sections of the terminal section, it is possible to improve the heat generation property of the terminal portion by the electric resistance welder, thereby allowing the element wires to be molten sufficiently.

It is preferable that the respective tips of the adjoining divided sections are folded back toward the base portion while facing different directions.

Since the divided sections are folded back toward the base portion so that respective tips of the adjoining divided sections face different directions, respective bending portions of the divided sections are arranged so as to intersect with each other, so that it is possible to improve the strength against the tensile force.

The conductive member may be shaped annularly.

Since the conductive member is shaped annularly, it is possible to heat up the divided sections forming the connection hole by the conductive member uniformly, thereby allowing the heat generation property of the terminal portion furthermore.

It is preferable that the conductive member includes a seat portion arranged between the divided sections, and an annular portion provided integrally with the seat portion to form the connection hole by the electric resistance welder.

Since the conductive member includes the seat portion disposed between the divided sections and the annular portion provided integrally with the seat portion to form the connection hole by the electric resistance welder, it is possible to improve the rigidity of the connection hole of the terminal portion by the annular portion while improving the heat generation property of the terminal portion by the seat portion, thereby allowing the strength against the tensile force to be improved furthermore.

According to the aspect of the present invention, it produces an effect of providing a terminal-equipped electrical wire capable of improving the heat generating property of the terminal portion by the electric resistance welder, thereby allowing the element wires to be molten sufficiently.

DESCRIPTION OF EMBODIMENTS

Figure 1:
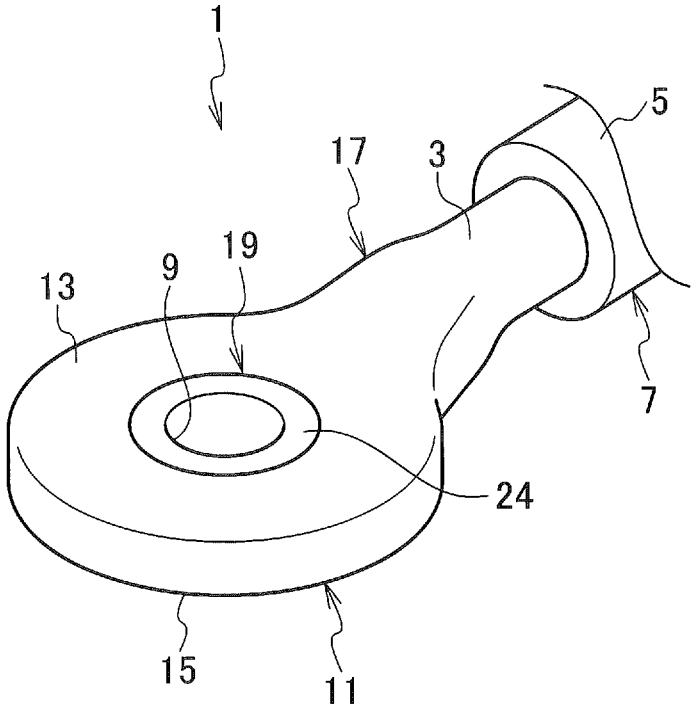
FIG. 1 is a perspective view of a terminal-equipped electrical wire according to an embodiment.
Figure 2:
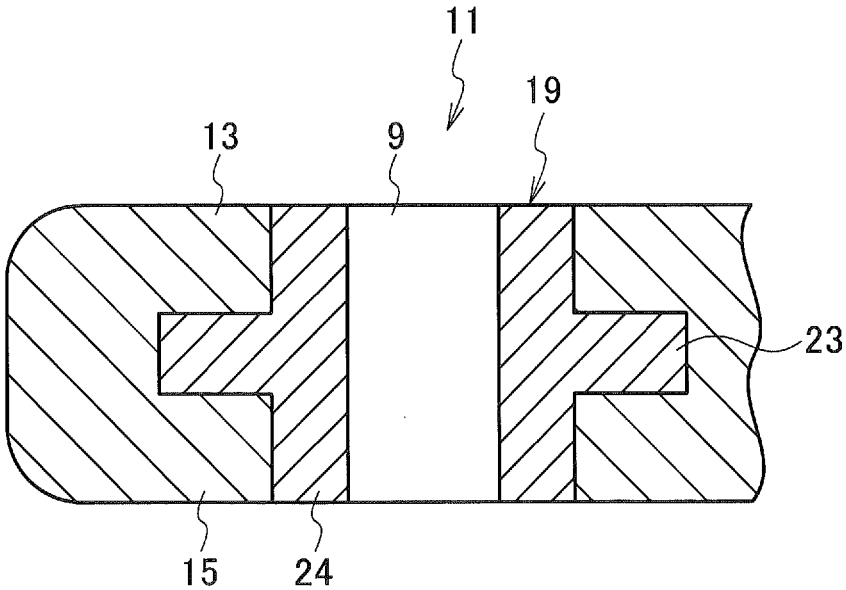
FIG. 2 is a sectional view of a terminal portion of the terminal-equipped electrical wire according to the embodiment.
Figure 3:
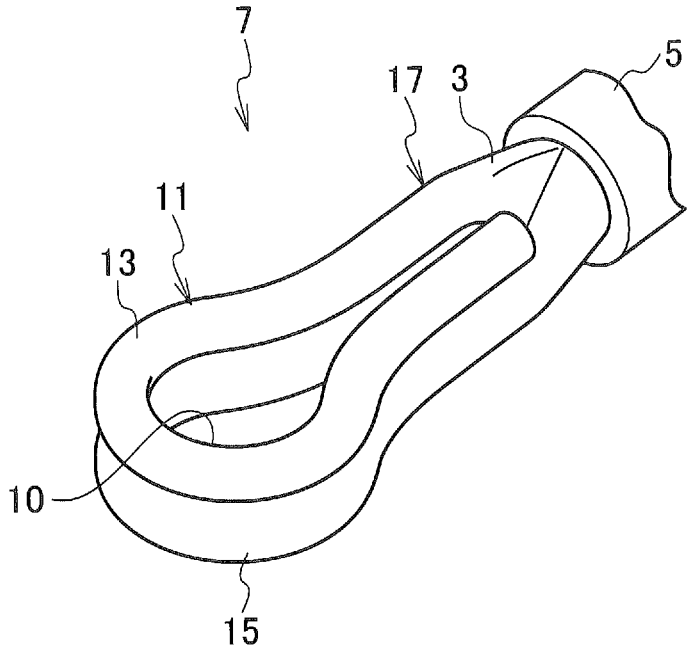
FIG. 3 is a perspective view illustrating an arrangement where divided sections are formed in a core wire of the terminal-equipped electrical wire according to the embodiment.
Figure 4:
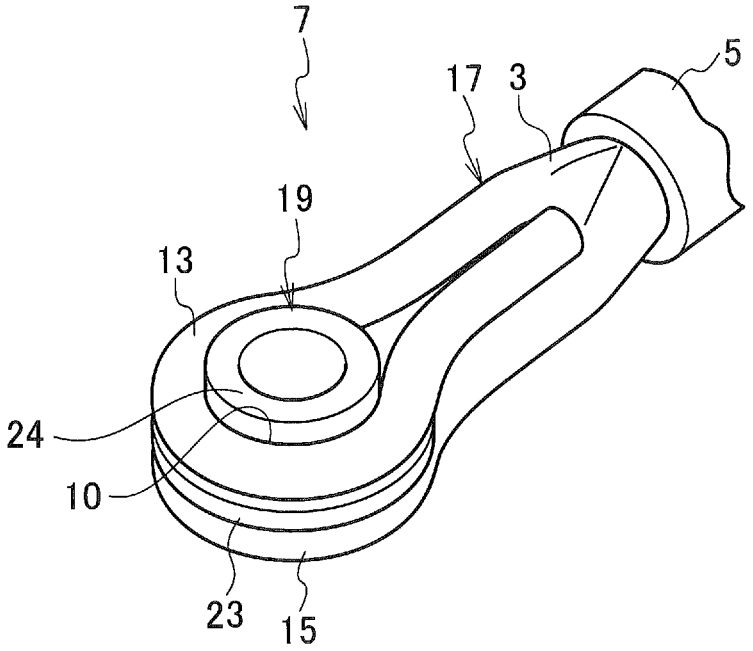
FIG. 4 is a perspective view illustrating an arrangement where a conductive member is arranged between the divided sections of the terminal-equipped electrical wire according to the embodiment.
Figure 5:
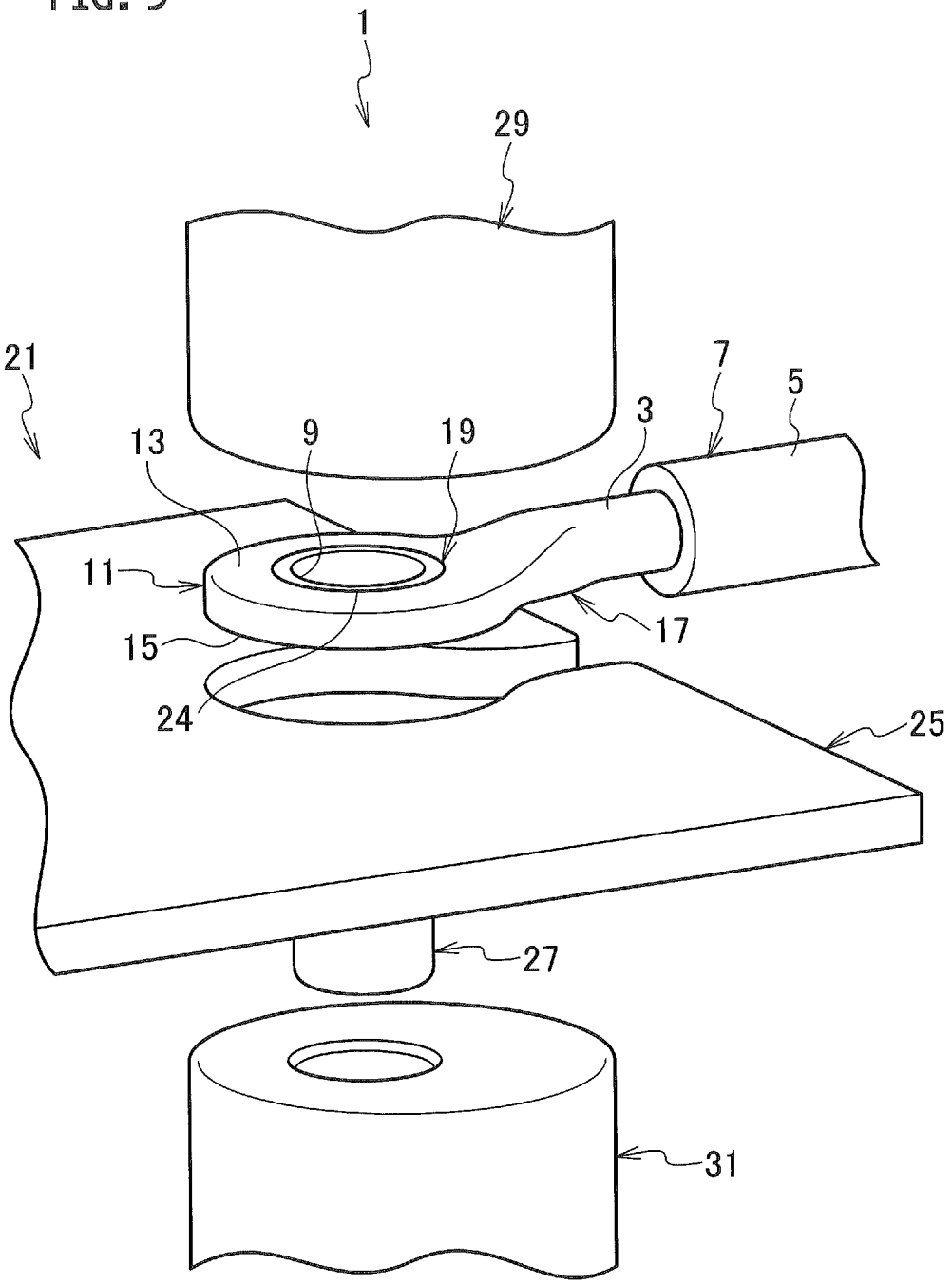
FIG. 5 is a perspective view illustrating an arrangement where the core wire of the terminal-equipped electrical wire according to the embodiment is configured as a terminal by using an electric resistance welder.

A terminal-equipped electrical wire according to an embodiment will be described with reference to FIGS. 1 to 5.

The terminal-equipped electrical wire 1 according to the embodiment includes a covered electrical wire 7 in which an outer periphery of a core wire 3 composed of a plurality of element wires is covered by a cover portion 5, and a terminal portion 11 provided at an end portion of the covered electrical wire 7 and also configured as a terminal by exposing the core wire 3 from the cover portion 5 while providing a connection hole 9 in the core wire 3.

At the terminal portion 11, the element wires of the core wire 3 are divided into two divided sections composed of a first divided section 13 and a second divided section 15. Respective tips of the first divided section 13 and the second divided section 15 are folded back toward a base portion 17 of the terminal portion 11, thereby defining a connection hole 9. The terminal portion 11 is configured as a terminal by an electric resistance welder 21 while arranging a conductive member 19 between the first divided section 13 and the second divided section 15.

In the first divided section 13 and the second divided section 15, their respective tips are folded back toward the base portion 17 while facing different directions.

The conductive member 19 is shaped annularly.

The conductive member 19 includes a seat portion 23 disposed between the first divided section 13 and the second divided section 15, and an annular portion 24 provided integrally with the seat portion 23 to define the connection hole 9 by the electric resistance welder 21.

As illustrated in FIGS. 1 to 5, the covered electrical wire 7 includes the core wire 3 and the cover portion 5. The core wire 3 is constructed by the element wires made of conductive material. The outer periphery of the core wire 3 is covered by the cover portion 5.

The cover portion 5, which is made of insulating material, covers the outer periphery of the core wire 3 in a tight-contact state and thus carries out insulating coating around the core wire 3. In the cover portion 5, its end portion is peeled off by a predetermined length to expose the end portion of the core wire 3 to outside. The exposed core wire 3 constitutes the terminal portion 11.

In the terminal portion 11, the element wires of the exposed core wire 2 are divided into two to form the first divided section 13 and the second divided section 15. In the first divided section 13 and the second divided section 15, respective tips are folded back toward the base portion 17 while facing respectively-different directions, thereby defining a base hole 10 that is the basis of the connection hole 9.

In detail, the element wires of the exposed core wire 3 are divided into two vertically, thereby providing the first divided section 13 and the second divided section 15. In the first divided section 13 and the second divided section 15, the upside-positioned first divided section 13 has its tip folded back toward the base portion 17 in the counter-clockwise direction. While, the downside-positioned second divided section 15 has its tip folded back toward the base portion 17 in the clockwise direction.

By folding back the first divided section 13 and the second divided section 15 in this way, the base hole 10 is defined at the terminal portion 11. Then, when electric resistance welding is applied to the first divided section 13 and the second divided section 15 by the electric resistance welder 21, the connection hole 9 is formed. The conductive member 19 is disposed between the first divided section 13 and the second divided section 15 forming the connection hole 9.

The conductive member 19, which is made of conducting material, is shaped annularly like a collar, a washer, or the like, and includes the seat portion 23 and the annular portion 24. The seat portion 23 is one member continuous to the annular portion 24 at the central part of the annular portion 24 and also provided in the form of a flange. The seat portion 23 is pinched between the first divided section 13 and the second divided section 15.

The annular portion 24 is arranged in the base hole 10 which is formed by folding back respective tips of the first divided section 13 and the second divided section 15 toward the base portion 17. Then, the annular portion 24 defines the connection hole 9 by applying electric resistance welding by the electric resistance welder 21.

Since the terminal portion 11 is applied electric resistance welding, from the base hole 10 to the base portion 17, by the electric resistance welder 21, the seat portion 23 and the annular portion 24 are configured as a terminal, together with the first divided section 13 and the second divided section 15. Then, the annular portion 24 located at the central part of the terminal portion 11 defines the connection hole 9.

The electric resistance welder 21 includes a pusher jig 25 for holding the terminal portion 11 to prevent a displacement of the terminal portion 11, a hole forming jig 27 for forming the connection hole 9, an upper electrode 29 and a lower electrode 31 respectively arranged above and below the pusher jig 25 and the hole forming jig 27 to pinch the terminal portion 11 from the vertical direction while pressurizing it for energization.

By electrifying the upper electrode 29 and the lower electrode 31 while pinching the terminal portion 11 between the upper electrode 29 and the lower electrode 31, the electric resistance welder 21 heats and thus melts the element wires of the core wire 3 at the terminal portion 11, thereby configuring the terminal portion 11 as a terminal.

At this time, as the conductive member 19 is interposed between the first divided section 13 and the second divided section 15, the inside part of the core wire 3 at the terminal portion 11 also generates heat to enable the element wires of the terminal portion 11 to be molten uniformly. For this reason, resistance among the element wires, which might be generated if the melting of the element wires was insufficient, vanishes away, so that the resistance of the terminal portion 11 can be reduced.

The terminal portion 11 configured as a terminal by the electric resistance welder 21 is electrically connected and also fixed to a mating connecting portion (not illustrated) of a mating terminal or instrument etc. by inserting a fastening member, such as a bolt, (not illustrated) into the connection hole 9.

When fastening the terminal portion 11 by the fastening member, the terminal portion 11 may be subjected to tensile force along a length direction of the covered electrical wire 7. However, it is noted that the connection hole 9 is defined by folding back the first divided section 12 and the second divided section 15 and additionally, the annular portion 24 of the conductive member 19 configured as a terminal is arranged in the connection hole 9. For this reason, the terminal portion 11 is prevented from tearing or shearing. Additionally, as the first divided section 13 and the second divided section 15 are folded back so as to intersect with each other in different directions, the strength against tensile force is improved.

Next, manufacturing method of the terminal-equipped electrical wire 1 according to the embodiment will be described. First, the cover portion 5 at the end portion of the covered electrical wire 7 is peeled off by a predetermined length to expose the end portion of the core wire 3 composed of the element wires. Then, the element wires in the exposed core wire 3 are divided into two parts so as to form the first divided section 13 on the upper side and the second divided section 15 on the lower side.

Subsequently, respective tips of the first divided section 13 and the second divided section 15 are folded back toward the base portion 17 in respectively different directions so as to intersect with each other at the folded-back point, thereby forming the base hole 10. Next, the conductive member 19 is arranged between the first divided section 13 and the second divided section 15 so as to form the connection hole 9.

Then, the whole terminal portion 11 extending from the base hole 10 up to the base portion 17 is arranged in the pusher jig 25 of the electric resistance welder 21 while arranging the base hole 10 (the annular portion 24 of the conductive member 19 in this case) around the hole forming jig 27 of the electric resistance welder 21. Subsequently, the first divided section 13, the second divided section 15, the conductive member 19, and the base portion 17 are pinched by the upper electrode 29 and the lower electrode 31. Then, by conducting electricity between the upper electrode 29 and the lower electrode 31, electric resistance welding is applied to configure the core wire 3 and the conductive member 19 as a terminal, thereby completing the terminal portion 11.

With the terminal-equipped electrical wire 1 according to the embodiment, the conductive member 19 is arranged between the first divided section 13 and the second divided section 15, and the terminal portion 11 is configured as a terminal by the electric resistance welder 21. Therefore, owing to the heating by the electric resistance welder 21 through the conductive member 19, the melting of the element wires can be carried out at the first divided section 13 and the second divided section 15 sufficiently, thereby allowing the resistance of the terminal portion 11 to be reduced.

Thus, with the terminal-equipped electrical wire 1 according to the embodiment, by interposing the conductive member 19 between the first divided section 13 and the second divided section 15 of the terminal portion 11, it is possible to improve the heat generation property of the terminal portion 11 by the electric resistance welder 21, thereby allowing the element wires to be molten sufficiently.

The first divided section 13 and the second divided section 15 have their respective tips folded back toward the base portion 17 while facing respectively-different directions. For this reason, since respective bending portions of the first divided section 13 and the second divided section 15 are arranged so as to intersect with each other, it is possible to improve the strength against the tensile force.

As the conductive member 19 is shaped annularly, the first divided section 13 and the second divided section 15 forming the connection hole 9 can be heated by the conductive member 19 uniformly, thereby allowing the heat generation property of the terminal portion 11 furthermore.

The conductive member 19 includes the seat portion 23 disposed between the first divided section 13 and the second divided section 15, and the annular portion 24 provided integrally with the seat portion 23 to form the connection hole 9 by the electric resistance welder 21. Therefore, it is possible to improve the rigidity of the connection hole 9 of the terminal portion 11 by the annular portion 24 while improving the heat generation property of the terminal portion 11 by the seat portion 23, thereby allowing the strength against the tensile force to be improved furthermore.

It is noted that, in the terminal-equipped electrical wire according to the embodiment, the core wire is divided into two parts, i.e. two divided sections including the first divided section and the second divided section. However, the present invention is not limited to this embodiment only and therefore, there may be provided three or more divided sections. In such a case, all one need to do is to arrange conductive members among the respective divided sections. Additionally, all one need to do is to fold back respective tips of adjoining divided sections toward the base portion while facing different directions.

In the terminal-equipped electrical wire according to the embodiment, repeatedly, the conductive member is shaped annularly. However, the invention is not limited to this embodiment only and therefore, the conductive member can be provided with any configuration, provided that it is arranged between the divided sections and can induce sufficient heat generation inside the core wire by energizing the electric resistance welder.

What is claimed is:

1. A terminal-equipped electrical wire, comprising:

a covered electrical wire in which an outer periphery of a core wire including a plurality of element wires is covered by a cover portion; and a terminal portion provided at an end portion of the covered electrical wire, the terminal portion configured as a terminal by exposing the core wire from the cover portion and providing a connection hole in the core wire, wherein at the terminal portion, the plurality of element wires of the core wire are divided into two or more divided sections, and respective tips of the divided sections are folded back toward a base portion of the terminal portion, thereby forming a connection hole, a conductive member is arranged between the divided sections, and the terminal portion is configured as the terminal by using an electric resistance welder.

2. The terminal-equipped electrical wire of claim 1, wherein the respective tips of the adjoining divided sections are folded back toward the base portion while facing different directions.

3. The terminal-equipped electrical wire of claim 1, wherein the conductive member is shaped annularly.

4. The terminal-equipped electrical wire of claim 3, wherein the conductive member includes:

a seat section arranged between the divided sections; and an annular portion provided integrally with the seat portion to form the connection hole by the resistance welder.

* * * * *